US006265821B1

(12) United States Patent
Seder

(10) Patent No.: US 6,265,821 B1
(45) Date of Patent: Jul. 24, 2001

(54) SERPENTINE AVIONICS FLUORESCENT TUBE WITH UNIFORMITY OF LUMINANCE AND CHROMATICITY

(75) Inventor: Thomas A. Seder, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 08/301,279

(22) Filed: Sep. 6, 1994

Related U.S. Application Data

(62) Division of application No. 08/021,366, filed on Feb. 23, 1993, now abandoned.

(51) Int. Cl.[7] ..... H01J 1/62
(52) U.S. Cl. ..... 313/485; 427/64
(58) Field of Search ..... 427/64, 67, 71, 427/68, 28; 313/485, 490; 315/50, 56; 118/72

(56) References Cited

U.S. PATENT DOCUMENTS

| | | | | |
|---|---|---|---|---|
| 2,192,869 | * | 3/1940 | Pearce | 313/485 |
| 2,336,946 | | 12/1943 | Marden et al. | 117/18 |
| 2,366,270 | * | 1/1945 | Lemmers | 427/64 |
| 3,303,042 | | 2/1967 | Reed et al. | 117/33.5 |
| 3,540,908 | * | 11/1970 | Carvell | 427/64 |
| 4,081,714 | * | 3/1978 | Mossel | 427/71 |
| 4,216,738 | * | 8/1980 | Muta | 118/72 |
| 4,337,414 | * | 6/1982 | Young | 315/56 |
| 4,597,984 | | 7/1986 | Jansma | 427/28 |

OTHER PUBLICATIONS

Tesla, "Experiments With Alternate Currents of High Potential and High Frequency". 2nd Ed. McGraw–Hill. New York. 1904. P133–135.*

Barden, W. "Color Computer Assembly Language Programming" Ft. Worth. 1983. Pp. 141–144.*

* cited by examiner

*Primary Examiner*—Xiao Wu
(74) *Attorney, Agent, or Firm*—Nathan O. Jensen; Kyle Eppele; James P. O'Shaughnessy

(57) ABSTRACT

A serpentine avionics fluorescent tube with enhanced uniformity of luminance and chromaticity where the serpentine tube has a phosphor coating deposited therein after the fluorescent tube has been bent into a serpentine shape by pulling a spay nozzle emitting phosphor through the previously bent fluorescent tube.

4 Claims, 1 Drawing Sheet

SERPENTINE AVIONICS FLUORESCENT TUBE WITH UNIFORMITY OF LUMINANCE AND CHROMATICITY

This Application is a File Wrapper Continuation of application Ser. No. 08/021,366 file Feb. 23, 1993, now abandoned.

CROSS-REFERENCE TO RELATED APPLICATIONS

This application is related to a co-pending application entitled "Method and Apparatus for Manufacturing Serpentine Avionics Fluorescent Tubes With Enhanced Uniformity Of Luminance and Chromaticity", filed by the same inventor on the same date herewith, and assigned to the same assignee, which application is incorporated herein by reference in its entirety.

BACKGROUND OF THE INVENTION

The present invention generally relates to fluorescent tubes and more particularly to serpentine fluorescent tubes for use in avionics equipment.

In today's aviation industry, avionics engineers are involved in a continuing quest to improve the optical performance of avionics displays. One particular area of concern is fluorescent lamps for back-lighting liquid crystal displays.

Typically, fluorescent lamps utilized in the avionics industry are serpentine and are constructed by creating a linear transparent glass tube and coating the interior of the tube with a fluorescent phosphor substance. The linear coated tubes are then fashioned into a serpentine shape by heating the glass tube to its working temperature and then bending the tube.

Another method has been to bend uncoated tubes into a "U" shape and then apply the phosphors via the typical phosphor slurry flush coat method used for linear tubes. Success has been claimed for uniform application of phosphors to "U" shapes using the flush coat method, but "S" shaped or "M" shaped tubes have not been uniformly phosphor coated with the typical slurry deposition method. In order to make "S" or "M" shaped tubes, it has been attempted to weld together 2 or 3 "U" shaped phosphor slurry coated tubes to create "S" and "M" shaped lamps respectively.

While these methods have been used widely in the past all existing methods of fabricating serpentine tubular lamps have several serious draw backs. First of all, when the tubes are bent after coating, the efficiency of the phosphors is diminished as a result of exposure to the high temperature required to allow bending of the tube. Secondly, the bending of the tube results in lacerations or cracks in the phosphor coating. This results in a diminution in luminance uniformity and chromaticity uniformity, as well as the absolute luminance per unit area.

In the method involving welding several slurry coated "U" shaped tubes together, the areas where the "welding" occurs are exposed to high temperatures and the phosphors therein are degraded as a result.

Consequently, there exists a need for improved manufacture of fluorescent tubes for use in the avionics industry, in which phosphor efficiency and uniformity of luminance and chromaticity are not degraded as a result of the fabrication process.

SUMMARY OF THE INVENTION

It is an object of the present invention to provide a fluorescent tube with enhanced phosphor efficiency.

It is a feature of the present invention to include a phosphor coating on the tube that is not reheated to a uniform temperature sufficient to bend the tube.

It is an advantage of the present invention to eliminate the adverse effects on the phosphors which occurs when they are heated to a temperature sufficient to bend the tube.

It is another object of the present invention to improve optical performance of fluorescent tubes.

It is another feature of the present invention to have a serpentine tube which is not bent after coating of the phosphor.

It is additional advantage of the present invention to eliminate the cracks and lacerations due to the bending of the tube and thereby reduce some of the adverse effects upon the uniformity of luminance and chromaticity.

The present invention provides an improved fluorescent tube having a non-reheated and non-bent phosphor coating disposed therein, which is to designed to satisfy the aforementioned needs, provide the previously propounded objects, include the above described features, and achieve the already articulated advantages. The invention is carried out in a "laceration-less" phosphor coating within the fluorescent tube in the sense that the lacerations typically associated with bending a phosphor coated tube into a serpentine shape have been eliminated. Additionally, the invention is carried out in an "excessive heat exposure-less" method in the sense that the excessive and phosphor damaging heat exposure associated with bending or welding a pre-phosphor coated tube is eliminated. Instead, the fluorescent tube contains a non-reheated and non-bent phosphor coating disposed therein after the fluorescent tube has been bent to a serpentine shape.

Accordingly, the present invention provides for a fluorescent tube having a uniform phosphor coating disposed therein which has not been heated to a temperature sufficient to permit bending of the fluorescent tube and which has not been cracked or lacerated to bending of the tube after coating of the phosphors.

BRIEF DESCRIPTION OF THE DRAWINGS

The invention may be more fully understood by reading the following description of the preferred embodiment of the invention in conjunction with the appended drawings wherein.

DETAILED DESCRIPTION

Figure 1:
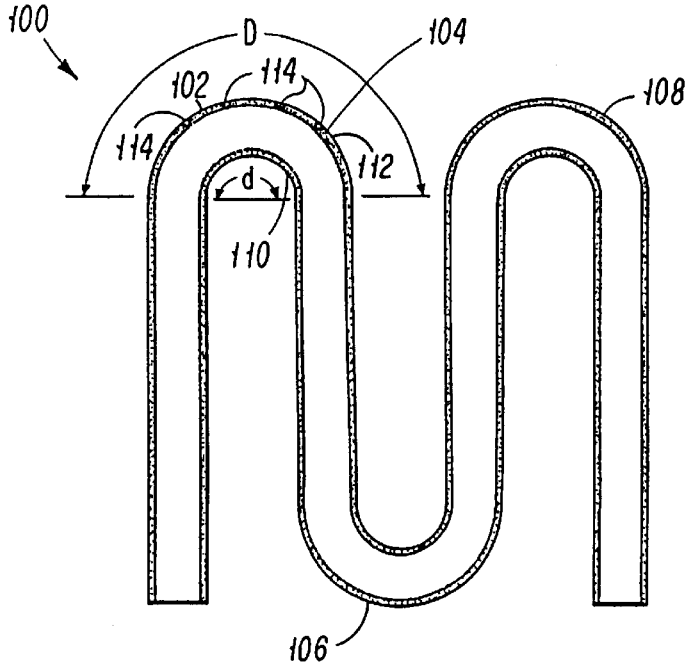
PRIOR ART FIG. 1
FIG. 1 is a cross-sectional view of a fluorescent tube, of the prior art, showing non-uniform phosphor distribution thereon.

Now referring to FIG. 1, there is shown a fluorescent tube, of the prior art, generally designated 100, having a phosphor coating 102 disposed therein. Fluorescent tube 100 is shown having a first bend 104, a second bend 106, and a third bend 108. First bend 104 is shown having a central side 110 and outer side 112. The dimension D of the outer side 112 is clearly shown to be greater than the linear dimension d of the central bend 110. The outer bend 112 is shown having several lacerations, cracks, or gaps 114 disposed therein. Typically, these lacerations, cracks, or gaps will in the phosphor coating appear when the tube 102 is bent. During the bending process the outer side 112 is stretched over a larger dimension than the innerside 110. Since the phosphor coating was deposited before the tube was bent, the coating becomes damaged upon excessively stretching the outer side 112. Bends 106 and 108 would have similar phosphor coating damage disposed therein.

Also due to the bending or welding process, the tube and phosphors deposited therein are heated typically to temperatures in excess of 700° C. These high temperatures cause the metal atoms in the phosphors to oxidize, which results in a degradation in the efficiency of the light output by such phosphors. It is believed that phosphors which emit blue light may be more adversely affected by this high temperature exposure and the concomitant metal atom oxidation. Additionally, subtle temperature induced changes in the phosphor lattice structure, such as amorphization, that perturb the crystal field, and consequently the energy levels, of the emitting phosphor atom, also contribute to a reduced phosphor quantum efficiency.

Figure 2:
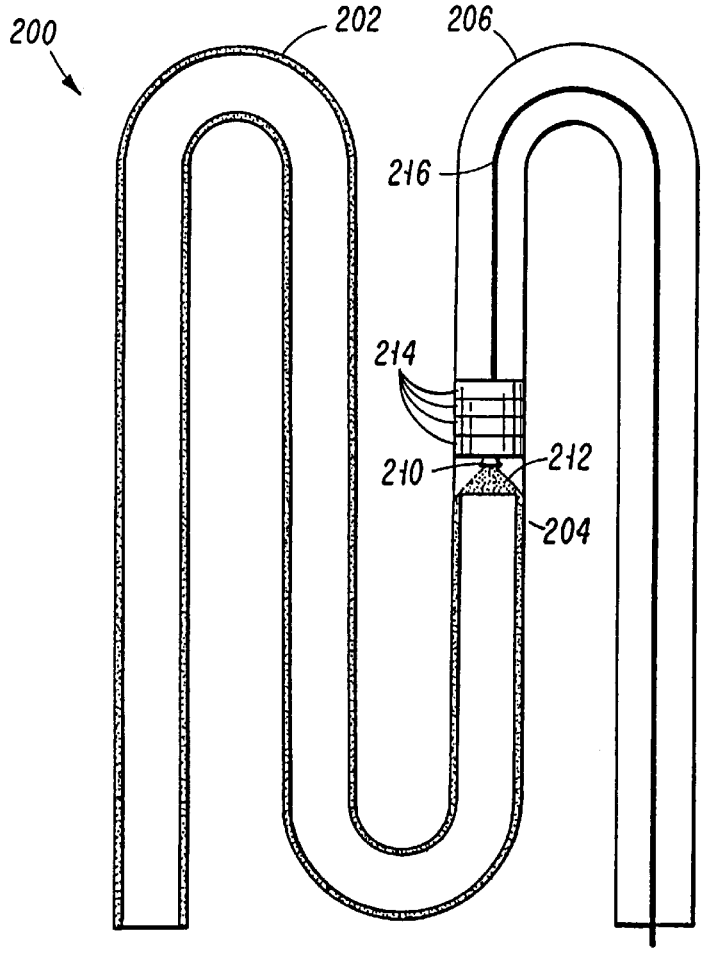
FIG. 2 is a cross-sectional view of the fluorescent tube, of the present invention showing the apparatus used to deposit the uniform phosphor coating.

Now referring to FIG. 2, there is shown a cross-sectional view of a serpentine avionics fluorescent tube of the present invention, generally designated 200, which shows a portion of the tube having already been coated with a phosphor layer 202 and a portion 204 of the tube in the process of having the phosphor layer being deposited and a portion 206 of the tube yet to be coated. Additionally, FIG. 2 shows the apparatus to use to coat the serpentine fluorescent tube of the present invention, which includes a spray nozzle 210 coupled to a hose 216 which is coupled to a pump or other device (not shown) for propelling the phophors through the hose 216 and out the nozzle 210 on to the tube. Since there is no bending of the tube after the coating is uniformly applied, the lacerations, cracks or gaps, 114 of FIG. 1 are not present in the present invention. Also shown are spacers 214 which help to center hose 216 and maintain a uniform spray 212.

Since no heating to temperatures sufficient for tube bending or welding is required during the manufacture of the present invention, the layer 202 contains fluorescent phosphor particles whose quantum efficiency has not been degraded by thermally induced oxidation-reduction chemical processes. In particular, the blue light emitting phosphors will exhibit a relatively high quantum efficiency since relatively few metal atoms per unit coating weight become oxidized after phosphor deposition. Similarly, the lattice of relatively few blue emitting phosphor particles per unit coating weight have been thermally damaged by the fabrication method of the present invention. Thus, total efficiency is higher. In comparison to the prior art of fabrication serpentine lamps, relatively few phosphors are destroyed by amorphization or oxidation that occurs when phosphors are exposed to temperatures sufficient to permit bending of the tube.

The term serpentine when used herein shall mean having at least two curved portions therein such as "S" or "M" shaped, but any shape with more than a single bend is contemplated.

It is thought that the fluorescent tube of the present invention and many of its attendant advantages will be understood from the foregoing description, and it will be apparent that various changes may be made in the form, the construction, and the arrangement of the parts, without departing from the spirit and the scope of the invention, or sacrificing all of their material advantages, the form herein being merely preferred or exemplary embodiments thereof.

I claim:

1. A miniature fluorescent tube comprising:

a nonlinear tube having a first end and a second end and at least two "U" shaped portions there between; and, a phosphor layer disposed in said tube by pumping phosphors through a hose coupled to a spray nozzle and dragging the hose and spray nozzle from said first end through said tube to said second end while phosphors are being pumped out the nozzle on to the tube.

2. A tube of claim 1 wherein at least three "U" shaped portions exist between said first end and said second end.

3. A lamp comprising:

a nonlinear tube having a first end and a second end and at least two "U" shaped portions there between;

a uniform phosphor layer, where the thickness of the phosphor layer always exceeds a predetermined minimum thickness and is less than a predetermined maximum thickness, where the difference in the predetermined minimum thickness and the predetermined maximum thickness is chosen to be a predetermined thickness gap such that a luminance variation caused by the predetermined thickness gap falls within a predetermined luminance variation gap, the phosphor layer disposed in said tube by pumping phosphors through a hose, and dragging the hose from said first end through said tube to said second end while pumping phosphors onto the tube.

4. A lamp of claim 3 wherein at least three "U" shaped portions exist between said first and said second ends.

* * * * *